US010781766B2

(12) United States Patent
Seegmüller et al.

(10) Patent No.: US 10,781,766 B2
(45) Date of Patent: Sep. 22, 2020

(54) OPERATING METHOD FOR OPERATING A FUEL INJECTION SYSTEM AND FUEL INJECTION SYSTEM

(71) Applicant: CONTINENTAL AUTOMOTIVE GMBH, Hannover (DE)

(72) Inventors: Oliver Seegmüller, Köfering (DE); Tobias Ritsch, Regensburg (DE)

(73) Assignee: Vitesco Technologies GmbH, Hannover (DE)

( * ) Notice: Subject to any disclaimer, the term of this patent is extended or adjusted under 35 U.S.C. 154(b) by 216 days.

(21) Appl. No.: 15/898,632

(22) Filed: Feb. 18, 2018

(65) Prior Publication Data

US 2018/0171923 A1 Jun. 21, 2018

Related U.S. Application Data

(63) Continuation of application No. PCT/EP2016/058210, filed on Apr. 14, 2016.

(30) Foreign Application Priority Data

Aug. 18, 2015 (DE) ..... 10 2015 215 691

(51) Int. Cl.
*F02D 41/22* (2006.01)
*F02M 63/02* (2006.01)
(Continued)

(52) U.S. Cl.
CPC ..... *F02D 41/22* (2013.01); *F02D 41/123* (2013.01); *F02D 41/3863* (2013.01);
(Continued)

(58) Field of Classification Search
CPC .... F02D 33/003; F02D 33/006; F02D 41/123; F02D 41/22; F02D 41/3863;
(Continued)

(56) References Cited

U.S. PATENT DOCUMENTS 4,455,987 A * 6/1984 Sudbeck ..... F02D 41/005 123/568.27
5,785,025 A * 7/1998 Yoshiume ..... F02D 33/003 123/458
(Continued)

FOREIGN PATENT DOCUMENTS

CN 101213364 A 7/2008
CN 102985670 A 3/2013
(Continued)

OTHER PUBLICATIONS

International Search Report and Written Opinion dated Jul. 27, 2016 from corresponding International Patent Application No. PCT/EP2016/058210.
(Continued)

*Primary Examiner* — Sizo B Vilakazi
*Assistant Examiner* — Anthony L Bacon

(57) ABSTRACT

Embodiments relate to an operating method for operating a fuel injection system of an internal combustion engine, wherein, upon a detection of a fault in the fuel injection system, and wherein a predefined pressure is overshot in a high-pressure region of the fuel injection system, an overrun mode of the internal combustion engine is deactivated, such that the internal combustion engine is operated exclusively in an injection mode.

18 Claims, 7 Drawing Sheets

(51) Int. Cl.

| | |
|---|---|
| ***F02M 63/00*** | (2006.01) |
| ***F02D 41/12*** | (2006.01) |
| ***F02D 41/38*** | (2006.01) |
| ***F02M 65/00*** | (2006.01) |

(52) U.S. Cl.
CPC ..... *F02M 63/005* (2013.01); *F02M 63/024* (2013.01); *F02M 63/0245* (2013.01); *F02M 65/003* (2013.01); *F02D 2041/224* (2013.01); *F02D 2200/0602* (2013.01); *F02M 2200/247* (2013.01)

(58) Field of Classification Search
CPC ..... F02D 2041/224; F02D 2041/227; F02M 63/005; F02M 63/025
See application file for complete search history.

(56) References Cited

U.S. PATENT DOCUMENTS

| | | | | |
|---|---|---|---|---|
| 6,024,064 | A | 2/2000 | Kato et al. | |
| 7,735,472 | B2 * | 6/2010 | Okamoto | F02D 41/22 123/179.17 |
| 2001/0025626 | A1 * | 10/2001 | Antonioli | F02D 41/221 123/456 |
| 2002/0112528 | A1 * | 8/2002 | Antonioli | F02D 41/0085 73/49.7 |
| 2003/0034010 | A1 * | 2/2003 | Kellner | F02M 59/366 123/446 |
| 2010/0122690 | A1 * | 5/2010 | Miyake | F02D 41/3836 123/457 |
| 2011/0196594 | A1 | 8/2011 | Hasegawa | |
| 2012/0065868 | A1 | 3/2012 | Ando | |
| 2012/0080010 | A1 * | 4/2012 | Nistler | F02D 41/3863 123/456 |
| 2015/0027403 | A1 | 1/2015 | Porten et al. | |

FOREIGN PATENT DOCUMENTS

| | | | |
|---|---|---|---|
| DE | 19937962 | A1 | 2/2001 |
| DE | 102008040629 | A1 | 1/2010 |
| DE | 102011086948 | A1 | 5/2013 |
| DE | 102012105818 | A1 | 1/2014 |
| EP | 1281860 | A2 | 2/2003 |
| EP | 2071167 | A1 | 6/2009 |
| EP | 2116711 | A1 | 11/2009 |
| EP | 2187029 | A1 | 5/2010 |
| EP | 2432983 | A1 | 3/2012 |
| JP | 2009138686 | A | 6/2009 |
| JP | 2009257277 | A | 11/2009 |
| JP | 2009270510 | A | 11/2009 |
| JP | 2010116881 | A | 5/2010 |
| JP | 2010156298 | A | 7/2010 |
| JP | 2011163220 | A | 8/2011 |
| JP | 2013002309 | A | 1/2013 |

OTHER PUBLICATIONS

German Office Action dated Mar. 11, 2016 for corresponding German Patent Application No. 10 2015 215 691.5.
Korean Notice of Allowance dated May 17, 2019 for corrresponding Korean application No. 10-2018-7004711.
Japanese Decision to Grant a Patent drafted Jun. 3, 2019 for the corresponding Japanese Patent Application No. 2018-508659.
Chinese Office Action dated Apr. 17, 2020 for corresponding Chinese Patent Application No. 201680048055.7.

* cited by examiner

OPERATING METHOD FOR OPERATING A FUEL INJECTION SYSTEM AND FUEL INJECTION SYSTEM

CROSS REFERENCE TO RELATED APPLICATIONS

This application claims the benefit of International application No. PCT/EP2016/058210, filed Apr. 14, 2016, which claims priority to German patent application No. 10 2015 215 691.5, filed Aug. 18, 2015, each of which is hereby incorporated by reference herein in its entirety.

FIELD OF INVENTION

The invention relates to an operating method with which a fuel injection system of an internal combustion engine is operated, and to a fuel injection system which is suitable in particular for carrying out the operating method.

BACKGROUND

Fuel injection systems, for example gasoline direct injection systems, have, in simplified terms, a high-pressure fuel pump, by means of which a fuel is highly pressurized, and a high-pressure region with a high-pressure accumulator, the so-called rail, and with at least one injector valve for injecting the highly pressurized fuel into an associated combustion chamber of an internal combustion engine. The stated components are connected to one another by means of high-pressure lines.

For the operation of the fuel injection system, a control device, the so-called ECU, with corresponding software is normally provided. By means of the control device, it is for example possible for the delivery power of the high-pressure fuel pump to be adapted. For this purpose, on the high-pressure fuel pump, for example, there is situated a valve, which may be formed for example as a so-called digital inlet valve. The digital inlet valve may for example be provided in a "currentless open" embodiment, that is to say open when electrically deenergized, though other embodiments are also possible and known. Furthermore, for the regulation of the injection pressure required at the injector valves, a high-pressure sensor is situated in the fuel injection system, which high-pressure sensor is normally attached to the high-pressure accumulator and serves for acquiring the so-called system pressure. In the case of gasoline as fuel, the system pressure typically lies in a range between 150 bar and 500 bar, and in the case of diesel as fuel, the system pressure typically lies in a range between 1500 bar and 3000 bar. Pressure regulation by acquisition of a signal of the high-pressure sensor, processing of the signal by means of the control device and alteration of the delivery power of the high-pressure fuel pump by means of the digital inlet valve is normally performed. The high-pressure fuel pump is normally mechanically driven by the internal combustion engine itself, for example by means of a camshaft.

In the described high-pressure fuel pumps with a digital inlet valve, faults may arise which lead to an undesirably increased delivery power of the high-pressure fuel pump. This may, for example, be caused by the inlet valve on the high-pressure fuel pump no longer being able to be fully opened or closed. It is, for example, also conceivable that, for example as a result of a spring breakage at a spring in the inlet valve, or further possible faults, the power delivery can no longer be controlled.

In such a fault situation, a volume flow for the high-pressure fuel pump is set in a manner dependent on the rotational speed of the internal combustion engine and the temperature prevailing in the fuel injection system. Here, the volume flow may be greater than the injection quantity of the at least one injector valve. For example, in a typical operating state, the so-called overrun mode of the internal combustion engine, no or only little injection is performed through the injector valve. Therefore, if the high-pressure fuel pump delivers an excessively large volume flow, an undesired pressure increase occurs in the fuel injection system.

To be able to deplete undesirably high pressures in the high-pressure region of the fuel injection system, it is common for a mechanical safety valve, a so-called pressure-limiting valve, to be provided on the high-pressure fuel pump, which valve can limit or restrict the pressure.

Typical p-Q characteristics of the pressure-limiting valve are configured such that a maximum pressure takes effect in the high-pressure accumulator, which maximum pressure exceeds the nominal pressures of the injector valve during normal operation.

After the fault situation, the pressure increases within a few pump strokes of the high-pressure fuel pump up to a maximum pressure, which takes effect in the high-pressure region.

The pressure-limiting valve is commonly designed so as to discharge into a pressure chamber of the high-pressure fuel pump, such that the pressure-limiting valve is hydraulically blocked during a delivery phase of the high-pressure fuel pump. This means that the pressure-limiting valve can open and discharge fuel out of the high-pressure region, exclusively in the suction phase of the high-pressure fuel pump. Such pressure-limiting valves are referred to as hydraulically blocked pressure-limiting valves.

Owing to the structural nature of the injector valve, the injector valve commonly opens counter to the pressure prevailing in the high-pressure accumulator. Here, in a manner dependent on the operating state of the internal combustion engine, an actuation profile is used for the actuation of the injector valve in order to open the injector valve such that an injection can begin.

Many injector valves are designed not for the maximum pressure in the fault situation but, in a cost-optimized manner, for normal operation. In this way, in fault situations with excessively high pressures in the high-pressure region, the injector valve can no longer open, and the internal combustion engine can thus no longer operate. This can result in a breakdown of a vehicle operated with the internal combustion engine.

SUMMARY

It is therefore an object of the invention to provide an operating method for operating a fuel injection system, and a corresponding fuel injection system, by means of which a failure of the internal combustion engine may be prevented even in a fault situation.

In an operating method for operating a fuel injection system of an internal combustion engine, it is firstly the case that a fuel injection system is provided, which has a high-pressure fuel pump with a pump piston which is movable in translational fashion in a pressure chamber during operation and which serves for highly pressurizing a fuel, a high-pressure region for storing the highly pressurized fuel, and at least one injector valve which is connected to the high-pressure region and which serves for injecting highly pressurized fuel into a combustion chamber of the internal combustion engine. At the same time, two operating states of the internal combustion engine are provided, wherein, in an overrun mode, no injection of fuel through the injector valve into the combustion chamber takes place, and, in an injection mode, at least one injection of fuel through the injector valve into the combustion chamber takes place. Furthermore, a pressure-limiting valve is provided which, when a predefined opening pressure is reached in the high-pressure region, discharges fuel from the high-pressure region into the pressure chamber of the high-pressure fuel pump. A fault situation in the fuel injection system is then detected, which lies in the fact that the predefined opening pressure is overshot in the high-pressure region. In this fault situation, the overrun mode of the internal combustion engine is deactivated, such that the internal combustion engine is operated exclusively in the injection mode.

When the fault situation occurs, a situation of overdelivery by the high-pressure fuel pump arises, wherein the fault situation is a problem in particular in the overrun mode or in operating states with a low injection quantity through the injector valve, such that the maximum pressure in the high-pressure region increases in a manner dependent on the present rotational speed of the internal combustion engine and the prevailing temperature. Here, if the pressure rises higher than the maximum admissible injector valve opening pressure, misfiring of the internal combustion engine may occur, or even a breakdown of a vehicle driven by means of the internal combustion engine may occur.

To prevent the pressure in the high-pressure region, which pressure prevails at the injector valve, from rising above the maximum admissible pressure at which the injector valve can still open, a countermeasure is implemented. Here, the fault situation is detected in which an opening pressure of the pressure-limiting valve is overshot, such that the excess fuel must be discharged from the high-pressure region. In this fault situation, the overrun deactivation is prohibited, that is to say a deactivation of the injector valve such that the internal combustion engine continues to be operated without an injection quantity is prohibited. This means that the overrun mode is deactivated, and only fired overrun, that is to say injection operation with an injection quantity, is permitted, in order to ensure that a certain fuel quantity is always discharged via the injector valve and thus removed from the high-pressure region. The pressure level in the high-pressure region is thereby lowered.

In an embodiment, the fault situation is detected by means of a high-pressure sensor arranged in the high-pressure region. Since such high-pressure sensors are generally provided in the high-pressure region of the fuel injection system in any case in order to regulate an actuation of the delivery power of the high-pressure fuel pump during normal operation, it is possible to dispense with additional sensors for the acquisition of the fault situation in the fuel injection system.

The opening pressure of the pressure-limiting valve is set to be lower than a maximum admissible maximum pressure in the high-pressure region, wherein the maximum pressure is defined in particular in a range above 500 bar. Here, the maximum pressure corresponds to the maximum admissible pressure at which the injector valve can still just open.

It is advantageously the case that such a quantity of fuel is injected through the injector valve in the injection mode that a high pressure lower than the described maximum pressure takes effect in the high-pressure region.

In a refinement, such a quantity of fuel is injected through the injector valve that a high pressure that corresponds to an opening pressure of the pressure-limiting valve takes effect in the high-pressure region.

Thus, a sufficient fuel quantity is discharged via the injector valve such that the pressure level in the high-pressure region remains at the opening pressure of the pressure-limiting valve, or at least below the maximum pressure critical for the opening of the injector valve, over the broadest possible operating ranges. The injector valve may thus continue to open counter to the high pressure prevailing in the high-pressure region.

In a refinement, upon a detection of re-entry into a normal mode of the fuel injection system in which the predefined opening pressure is undershot again in the high-pressure region, the overrun mode is activated again. By means of the high-pressure sensor, it is possible to detect that the high-pressure in the high-pressure region has fallen again to such an extent that the pressure-limiting valve no longer has to open for the discharge of fuel into the pressure chamber of the high-pressure fuel pump. In this case, in the high-pressure region, a high pressure prevails counter to which the injector valve may easily open. Therefore, the overrun mode may then be departed from again, and the internal combustion engine may be operated without an injection quantity.

In addition to the described overrun deactivation, it is advantageous if further methods are implemented which prevent a shutdown of the internal combustion engine.

In a first embodiment, for this purpose, a period duration with four evenly distributed quadrants is determined between a first top dead center (TDC) time, at which the pump piston is at a top dead center, and a second TDC time, in which the pump piston is at the top dead center, wherein the injector valve is actuated such that an opening time of the injector valve lies in an opening duration which extends in a second quadrant of the period duration and/or in a third quadrant of the period duration.

Since the pressure-limiting valve discharges into the pressure chamber of the high-pressure fuel pump, it is hydraulically blocked in the delivery phase of the high-pressure fuel pump. Owing to the opening and closing of the pressure-limiting valve, a state of approximate equilibrium between delivery by the high-pressure fuel pump and return delivery via the pressure-limiting valve in the fault situation is similar to a sinusoidal curve. The high pressure prevailing in the high-pressure region therefore has cyclic pressure peaks and pressure troughs, wherein the difference between a pressure peak and a pressure trough is system-dependent and may, for example, be 50 bar. The pressure peaks therefore substantially coincide with the time at which the pump piston of the high-pressure fuel pump is at the top dead center and is delivering fuel into the high-pressure region. A period duration is in this case a duration between two such pressure peaks, that is to say two such TDC times. A pressure trough normally lies in the center between two such TDC times. If the injector valve is now actuated such that its opening time lies in the region of the pressure trough, that is to say in a duration shortly before the pressure trough to shortly after the pressure trough, the injector valve opens exactly when the lowest possible pressure despite the fault situation prevails in the high-pressure region. Depending on the design of the injector valve, the pressure difference between pressure peak and pressure trough is enough that the maximum admissible maximum pressure, at which the injector valve can still just open, is just undershot. If the period duration is divided into four equally sized quadrants, the pressure trough extends between the two TDC times in the second and third quadrants. It is therefore advantageous if the injector valve is actuated such that it is opened in a duration in which the fuel injection system is, in terms of time, situated in the second quadrant and/or in the third quadrant of the period duration.

For the detection of the TDC times at which the pump piston is situated at the top dead center, a characteristic map is stored which assigns a predetermined crank angle of the internal combustion engine to the top dead center. This is because, by means of the mechanical connection of the high-pressure fuel pump by means of, for example, a camshaft to, for example, a crankshaft of the internal combustion engine, the position of the top dead center, and self-evidently also of a bottom dead center, is known by means of the characteristic map. If, for the detection of the TDC times at which the pump piston is situated at the top dead center, a crank angle of the internal combustion engine is acquired. It is then possible by means of the characteristic map to exactly determine the times at which the pump piston is situated at the top dead center.

As an alternative to the variation of the opening time of the injector valve, it is however also possible for a further measure by means of which an opening of the injector valve is made possible even in the fault situation to be implemented in addition to the deactivation of the overrun mode of the internal combustion engine.

For this purpose, it is the case that a period duration with four evenly distributed quadrants is determined between a first TDC time, at which the pump piston is situated at the top dead center, and a second TDC time, at which the pump piston is situated at the top dead center, and then an injection time at which the injector valve begins to inject fuel is defined. Then, a camshaft angle of the camshaft is adjusted relative to the pump piston such that the injection time lies in a duration which extends in a first and/or second quadrant of the period duration. This means that, instead of a shift of the opening time of the injector valve, the time of the top dead center of the pump piston is shifted such that a previously fixed injection time, that is to say an injection time that was previously not variable in terms of its time, of the injector valve is situated in the above-described pressure trough.

The injection time of the injector valve thus falls into the negative amplitude of the rail pressure oscillation, whereby the injector valve may still open even if the averaged pressure in the high-pressure accumulator is above the pressure critical for the injector opening.

A fuel injection system for injecting fuel into combustion chambers of an internal combustion engine is designed in particular for carrying out the operating method described above. For this purpose, the fuel injection system has a high-pressure fuel pump with a pump piston which moves in translational fashion in a pressure chamber during operation and which serves for highly pressurizing a fuel, and a high-pressure region for storing the highly pressurized fuel. Furthermore, the fuel injection system has at least one injector valve which is connected to the high-pressure region and which serves for injecting highly pressurized fuel into a combustion chamber of the internal combustion engine. Furthermore, the fuel injection system has a pressure-limiting valve which, when a predefined opening pressure is reached in the high-pressure region, discharges fuel from the high-pressure region into the pressure chamber of the high-pressure fuel pump. Additionally, a control device is provided which is designed to provide at least two operating states of the internal combustion engine, wherein, in an overrun mode, no injection of fuel through the injector valve into the combustion chamber takes place, wherein, in an injection mode, at least one injection of fuel through the injector valve into the combustion chamber takes place. The control device is additionally designed to detect a fault situation in the fuel injection system, wherein the predefined opening pressure is overshot in the high-pressure region, and to deactivate the overrun mode of the internal combustion engine in the fault situation, such that the internal combustion engine is operated exclusively in the injection mode.

BRIEF DESCRIPTION OF THE DRAWINGS

Advantageous configurations of the invention will be discussed in more detail below on the basis of the appended drawings, in which.

DETAILED DESCRIPTION

Figure 1:
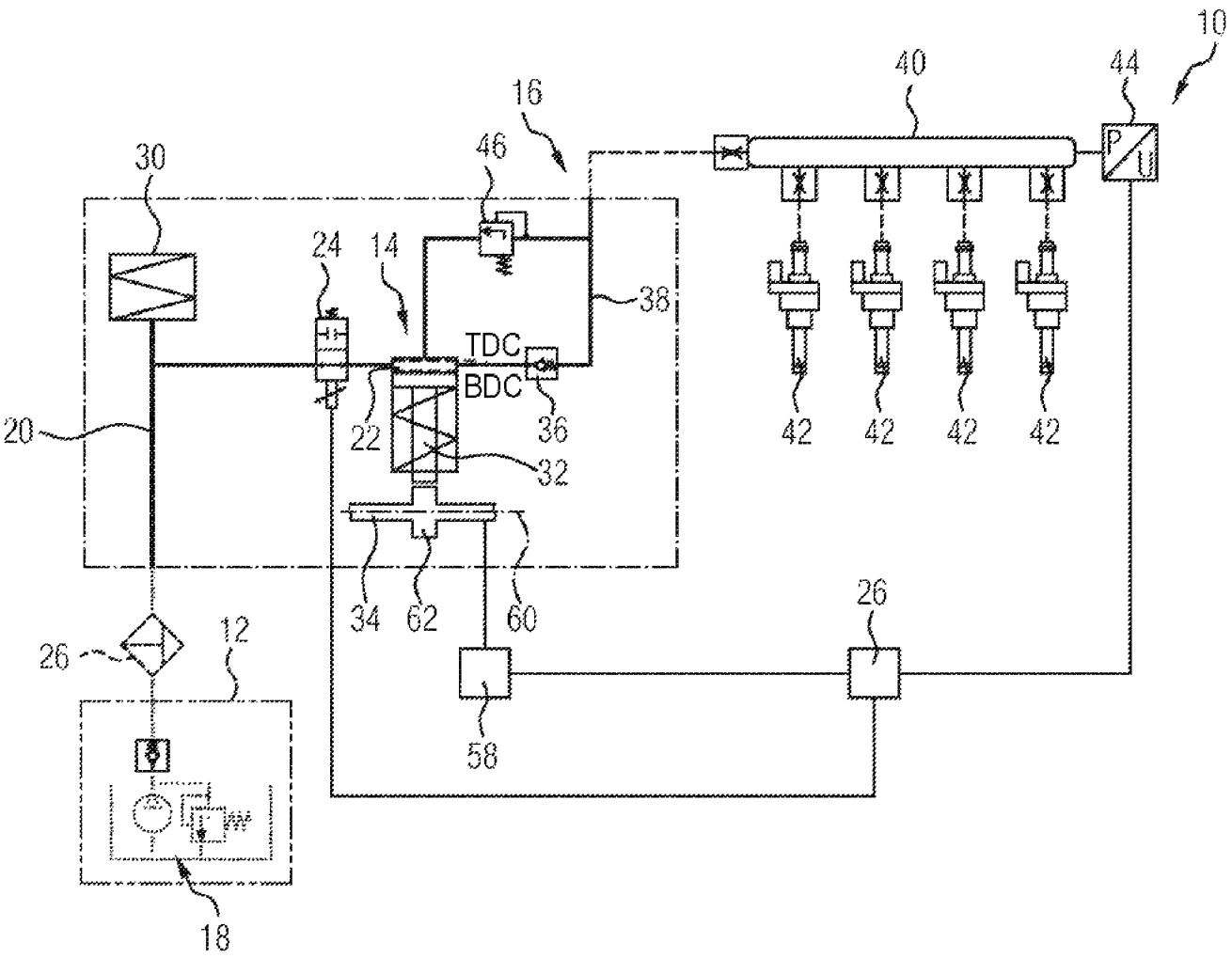
FIG. 1 is a schematic illustration of a fuel injection system for injecting fuel into combustion chambers of an internal combustion engine.

FIG. 1 shows a fuel injection system 10 by means of which fuel may be injected into combustion chambers of an internal combustion engine. For this purpose, the fuel injection system 10 has a fuel accumulator 12 such as for example a tank, a high-pressure fuel pump 14, and a high-pressure region 16 situated downstream of the high-pressure fuel pump 14. From the fuel accumulator 12, fuel is pumped for example by means of a tank pump 18 into a low-pressure line 20 and is thus delivered to a pressure chamber 22 of the high-pressure fuel pump 14. To be able to regulate a delivery power of the high-pressure fuel pump 14, a digital inlet valve 24 is connected upstream of the pressure chamber 22 in the low-pressure line 20. The digital inlet valve 24 may be actuated by a control device 26 in order to regulate the fuel quantity that is highly pressurized by the high-pressure fuel pump 14 in the pressure chamber 22. Additional elements such as filters 28 and an evaporator 30 are arranged in the low-pressure line 20 in order to purify the fuel from the fuel regulator 12 and also dampen pulsation damping actions in the low-pressure line 20.

A pump piston 32 moves in translational fashion back and forth in the pressure chamber 22, and in so doing increases and decreases the volume of the pressure chamber 22. The pump piston 32 is driven in its translational movement by a camshaft 34. Here, the camshaft 34 is coupled for example to a crankshaft of the internal combustion engine and is thus driven by the internal combustion engine itself. During the movement of the pump piston 32 in the pressure chamber 22, the pump piston 32 reaches a top dead center TDC at the moment at which the pressure chamber 22 has its smallest volume, and reaches a bottom dead center (BDC) at the moment at which the pressure chamber 22 reaches its largest volume. The corresponding times are thus the TDC time and the BDC time.

Highly pressurized fuel is then released via an outlet valve 36 from the high-pressure fuel pump 14 into the high-pressure region 16 and is conducted via a high-pressure line 38 to a pressure accumulator 40, in which the highly pressurized fuel is stored until it is injected via injector valves 42, which are arranged on the pressure accumulator 40, into combustion chambers of an internal combustion engine.

To regulate the delivery power of the high-pressure fuel pump 14, there is arranged on the pressure accumulator 40 a high-pressure sensor 44 which monitors the pressure prevailing in the pressure accumulator 40. The high-pressure sensor 40 transmits a signal to the control device 26, which then actuates the inlet valve 24 in a manner dependent on this signal, such that the high pressure in the pressure accumulator 40 may be regulated.

In a fault situation, it may be the case that the high-pressure fuel pump 14 has an increased delivery power, and thus a pressure is generated in the pressure accumulator 40 which is much higher than a normal pressure during normal operation. For this situation, a pressure-limiting valve 46 is provided on the high-pressure line 38, which pressure-limiting valve discharges fuel from the high-pressure region 16 in order to thereby lower the pressure in the high-pressure region 16. Here, the pressure-limiting valve 46 discharges the fuel into the pressure chamber 22 of the high-pressure fuel pump 14. Since the pressure-limiting valve 46 is normally formed as a check valve, the pressure-limiting valve 46 is hydraulically locked when the high-pressure fuel pump 14 is in the delivery phase, that is to say when fuel in the pressure chamber 22 is highly pressurized and is then discharged via the outlet valve 36 into the high-pressure region 16. However, if the high-pressure fuel pump 14 is situated in a suction phase, the pump piston 32 moves towards its bottom dead center, the volume in the pressure chamber 22 is expanded, and the pressure-limiting valve 46 may open and discharge fuel into the pressure chamber 22.

Here, an opening pressure $P_{open}$ is set so as to be lower than a maximum admissible maximum pressure $P_{max}$ in the high pressure region 16 at which it is still just possible for the injector valves 42 to open counter to the high pressure and inject fuel into the combustion chambers. For example, such a maximum pressure $P_{max}$ lies above 500 bar. The opening pressure $P_{open}$ of the pressure-limiting valve 46 is thus advantageously set in a range between 300 bar and 500 bar. This exceeds the nominal pressures of approximately 250 bar during normal operation, in the case of which the injector valves 42 may be operated without problems.

In a fault situation as described above, for example as a result of a spring breakage at the inlet valve 24 or other fault situations that prevent regulation of the pump delivery power, the high-pressure fuel pump 14 passes into the state of so-called full delivery, and delivers fuel unhindered into the high-pressure region 16. Since the pressure-limiting valve 46 may discharge the fuel into the pressure chamber 22 only during the suction phase of the high-pressure fuel pump 14, the high pressure in the high-pressure region 16 increases within a few pump strokes to a maximum which takes effect.

This will be briefly discussed with reference to the diagram in FIG. 2. Here, the diagram illustrates a pressure-time diagram, wherein a pressure p in the high-pressure region 16 is plotted versus a time t in which the high-pressure fuel pump 14 performs pump strokes.

Here, the fault situation occurs at a time $t_1$. As can be seen, the pressure p in the high-pressure region 16 increases continuously after this time $t_1$ until the opening pressure $P_{open}$ of the pressure-limiting valve 46 is reached at a time $t_2$.

Figure 2:
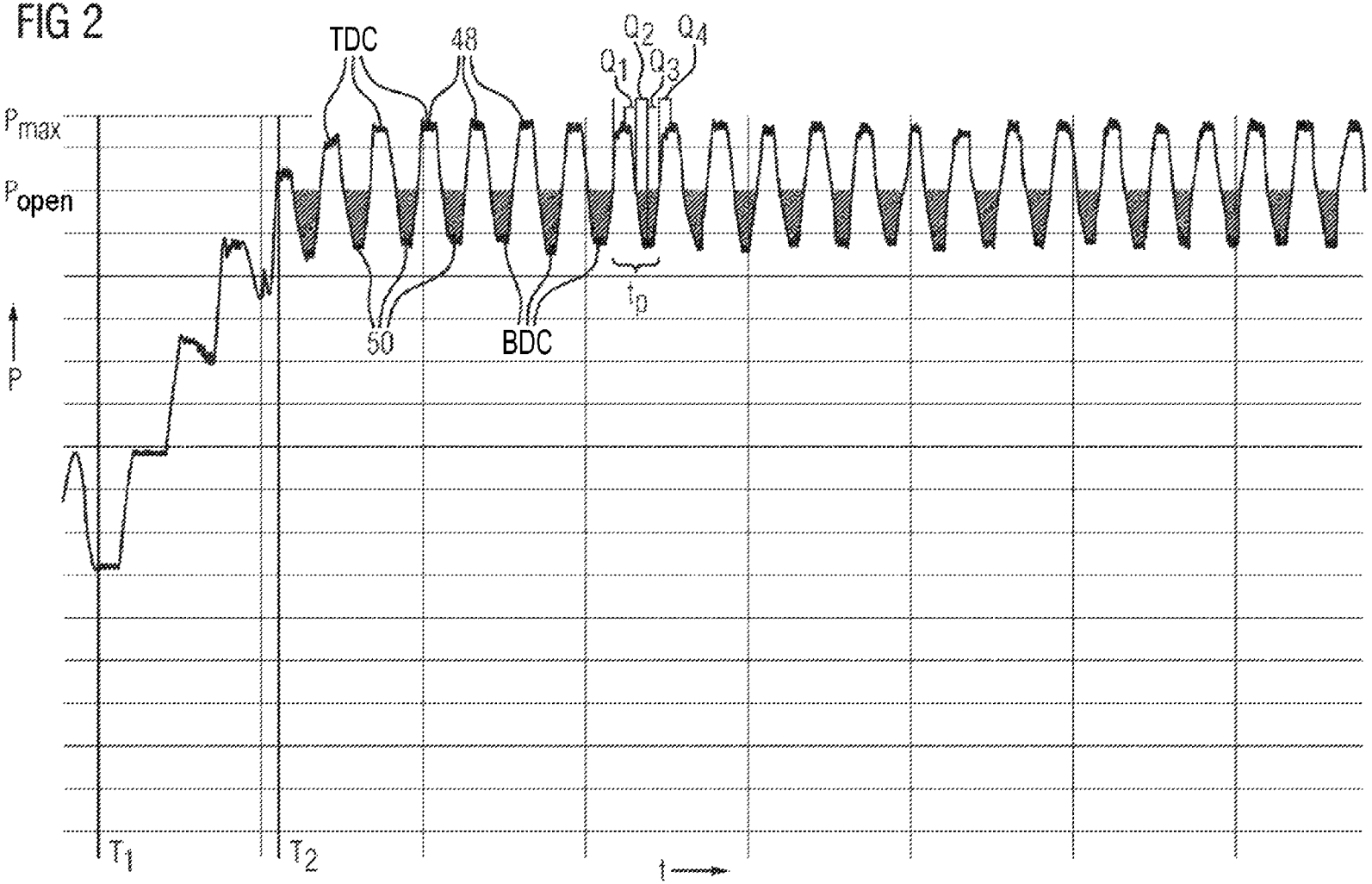
FIG. 2 shows a pressure-time diagram which illustrates a pressure oscillation in a high-pressure region of the fuel injection system from FIG. 1 in a fault situation.

Here, the diagram in FIG. 2 shows the pressure build-up after a fault situation in which the high-pressure fuel pump 14 is set into a full delivery position. The speed with which the opening pressure $P_{open}$ of the pressure-limiting valve 46 is reached is dependent on the rotational speed of the high-pressure fuel pump 14, which is dependent on a rotational speed of the crankshaft of the internal combustion engine. Furthermore, the pressure increase is also dependent on the temperature in the fuel injection system 10. Here, FIG. 2 illustrates a situation in which the internal combustion engine is in the overrun mode, that is to say in an operating state in which no injection of fuel through the injector valve 42 into the combustion chamber occurs.

Since the pressure-limiting valve 46 may discharge into the pressure chamber 22 only when the pressure in the pressure chamber 22 is lower than in the high-pressure region 16, a pressure oscillation occurs in the high-pressure region 16, which is distinguished by the fact that, during the discharging of the pressure-limiting valve 46, the high pressure in the high-pressure region 16 falls and then increases again if the pressure-limiting valve 46 is hydraulically blocked. Owing to the embodiment of the pressure-limiting valve 46 as a hydraulically blocked pressure-limiting valve, the characteristic shown in FIG. 2 is thus realized, with pressure peaks 48 when the high-pressure fuel pump 14 is in the delivery phase and with pressure troughs 50 when the high-pressure fuel pump 14 is in the suction phase.

If a fault situation arises which leads to overdelivery or full delivery of the high-pressure fuel pump 14, the maximum pressure in the pressure accumulator 40 therefore increases, in particular in the overrun mode or in operating states with a low injection quantity, in a manner dependent on the present rotational speed of the internal combustion engine and the temperature in the fuel injection system 10. In the case of pressures higher than the maximum admissible injector opening pressure $P_{max}$, misfiring of the internal combustion engine or even a breakdown of a vehicle operated with the internal combustion engine may occur.

To prevent the pressure that prevails at the injector valves 42 from increasing beyond the maximum pressure $P_{max}$ at which the injector valves 42 still open, the methods described below may be carried out. Below, three different methods will be described, which may be implemented as countermeasures; the methods may be implemented in each case individually or in combination. The control device 26 is in each case designed to carry out each of the methods. If the methods are carried out simultaneously, the control device 26 is configured correspondingly.

Below, however, for the sake of clarity, the methods will be described only as methods to be carried out individually.

A first countermeasure with which a shutdown of the internal combustion engine may be prevented is in this case a so-called overrun deactivation, which will be described below with reference to FIG. 3 and FIG. 4.

Figure 3:
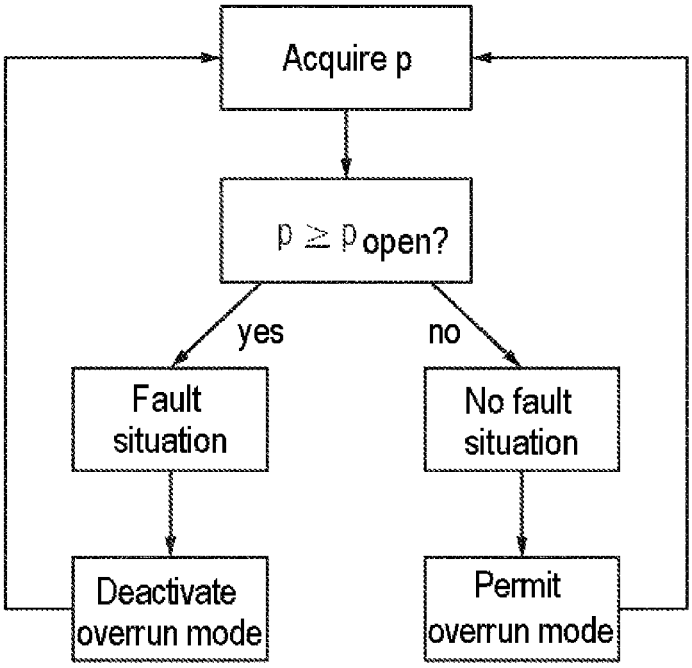
FIG. 3 shows a flow diagram which schematically illustrates an operating method for operating the fuel injection system from FIG. 1 in the fault situation, in a first embodiment.
Figure 4:
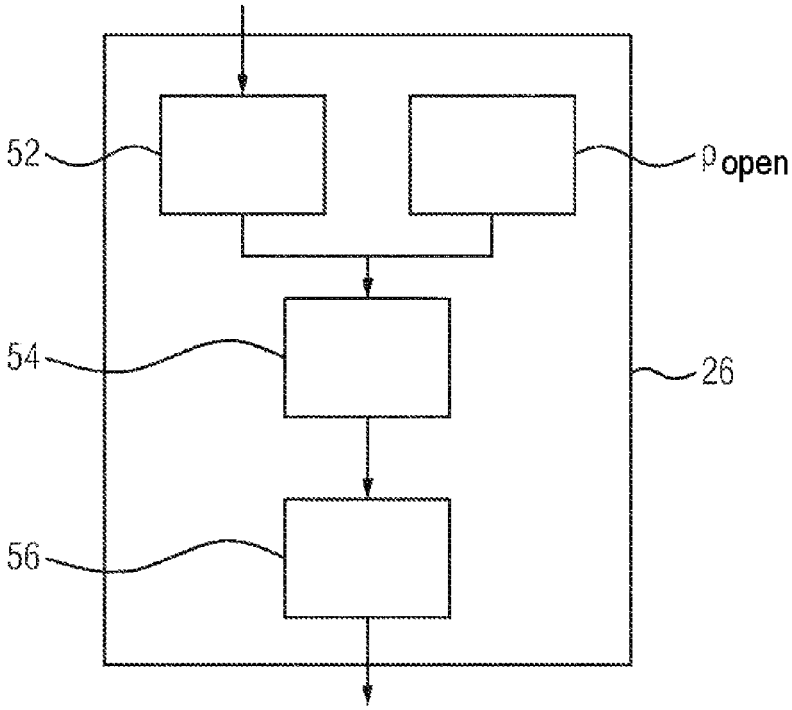
FIG. 4 is a schematic illustration of a control device which is designed for carrying out the operating method as per FIG. 3.

Here, FIG. 3 schematically shows, on the basis of a flow diagram, the steps of an operating method with which such overrun deactivation may be implemented, whereas FIG. 4 schematically shows the control device 26 that is configured for carrying out the operating method as per FIG. 3.

The internal combustion engine is operated by the control device 26 in at least two operating states, specifically in an overrun mode and in an injection mode. Here, in the overrun mode, no fuel is injected via the injector valves 42 into the combustion chambers of the internal combustion engine, whereas, in the injection mode, at least one injection of fuel through the injector valves 42 into the combustion chambers occurs.

In the operating method, in a first step, a pressure p in the high-pressure region 16 is firstly acquired by means of the high-pressure sensor 44. For this purpose, the control device 26 has a pressure acquisition device 52, which communicates with the high-pressure sensor 44. The opening pressure $P_{open}$ of the pressure-limiting valve 46 is also stored in the control device 26.

In a subsequent step of the operating method, it is therefore determined, by means of a fault detection device 54 of the control device 26, whether the pressure p is higher than or equal to the opening pressure $P_{open}$ of the pressure-limiting valve 46. If this is the case, the fault detection device 54 detects that a fault situation is present. In this case, the overrun mode of the internal combustion engine is deactivated by an overrun deactivation device 56 in the control device 26. This means that an overrun deactivation of the injector valves 42, such that they inject no further fuel into the internal combustion engine, is prohibited, and only fired overrun, that is to say the injection mode of the internal combustion engine, is permitted by the control device 26. It is thereby ensured that always a certain fuel quantity is discharged via the injector valves 42 and thus extracted from the high-pressure region 16. The pressure level in the high-pressure region 16 is in this case kept below the critical pressure $P_{max}$ for the injector opening, and is preferably even lowered to such an extent as to lie in the range of the opening pressure $P_{open}$ of the pressure-limiting valve 46.

After detection of the fault situation that leads to the uncontrolled delivery by the high-pressure fuel pump 14, therefore, the overrun mode, in which no fuel is injected, is prohibited, and instead, only an operating state with an at least small injection quantity is permitted and also implemented. The corresponding function is in this case stored in the control device 26.

If it is, however, identified in the operating method that the pressure p in the high-pressure region 16 is not higher than or equal to the opening pressure $P_{open}$ of the pressure-limiting valve 46, the fault detection device 54 identifies that no fault situation is present, and the overrun mode of the internal combustion engine remains permitted. Both after permission of the overrun mode and after deactivation of the overrun mode, it is always the case that the pressure p in the high-pressure region 16 is acquired again and it is checked whether the pressure is higher than or equal to the opening pressure $P_{open}$ of the pressure-limiting valve 46.

If the situation arises in which, after deactivation of the overrun mode, the pressure p in the high-pressure region has fallen below the opening pressure $P_{open}$, the fault detection device 54 detects that the fuel injection system 10 has entered a normal mode again. In this case, the overrun mode may then be reactivated. This means that the functionality may be optionally withdrawn again in a manner dependent on the pressure conditions in the fuel injection system 10.

Altogether, by means of the operating method, the risk of a breakdown of a vehicle operated with the internal combustion engine is reduced. Here, the fault situation is not relevant to the exhaust gas. A possible power loss is acceptable in the fault situation.

An actuation method for actuating the fuel injection system 10, which may be carried out alternatively or in addition to the overrun deactivation described above, will be described below with reference to FIG. 5 and FIG. 6. Here, a camshaft angle of the camshaft 34 relative to the pump piston 32 is adjusted in targeted fashion by means of a camshaft adjuster 58 provided in the fuel injection system 10.

The camshaft 34 rotates about a camshaft axis 60, wherein, at regular intervals, a cam 52 comes into contact with the pump piston 32 such that the pump piston 32 is moved toward the top dead center TDC. As the camshaft 34 rotates onward, the cam 62 moves away from the pump piston 32 again, and the pump piston 32 moves in the direction of the bottom dead center BDC. Therefore, in periodic intervals, the pump piston 32, moved by the cam 62, is situated alternately at the top dead center TDC and at the bottom dead center BDC. However, if an angle between pump piston 32 and the camshaft 34 is adjusted during the operation of the camshaft 34, the spacing between two successive top dead centers TDC is no longer uniform, as illustrated for example in the diagram shown in FIG. 2, it rather being the case that the TDC time of the top dead center TDC changes.

The adjustment of the angle of the camshaft 34 may likewise be induced by means of the control device 26, by means of a cam angle adjustment device 64 arranged in the control device 26.

If an injection time $t_I$ at which the injector valves 42 begin the injection of fuel into the combustion chambers is known, for example by virtue of an opening time $t_{open}$ for the injector valves 42 being set by means of an opening time setting device 66 in the control device 26, the camshaft 34 may be adjusted by means of the camshaft angle adjustment device 64 such that the injection time $t_I$ is situated in the pressure trough shown in FIG. 2.

Figure 5:
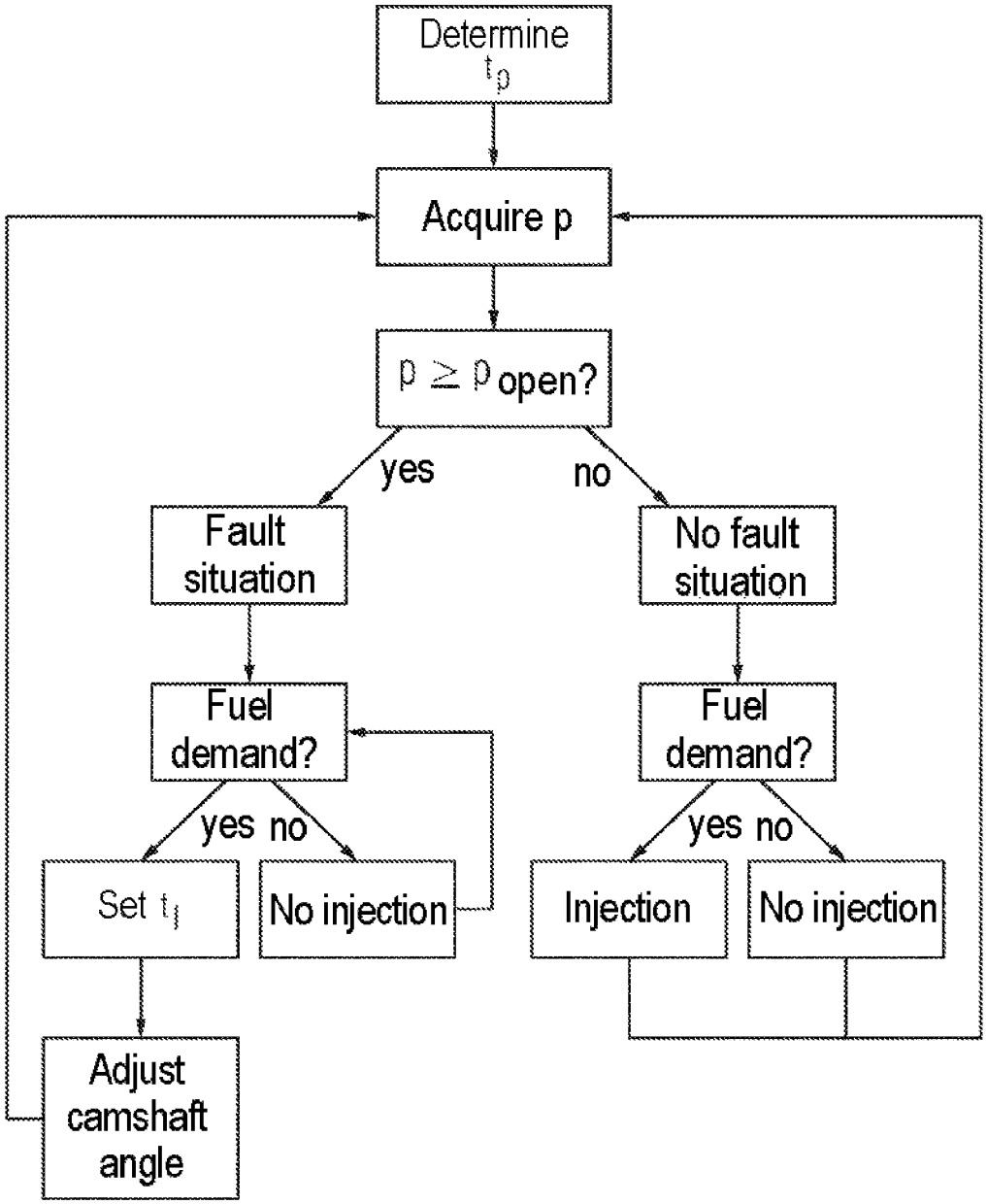
FIG. 5 shows a flow diagram which schematically illustrates an actuation method for the actuation of the fuel injection system from FIG. 1 in a fault situation, in a second embodiment.
Figure 6:
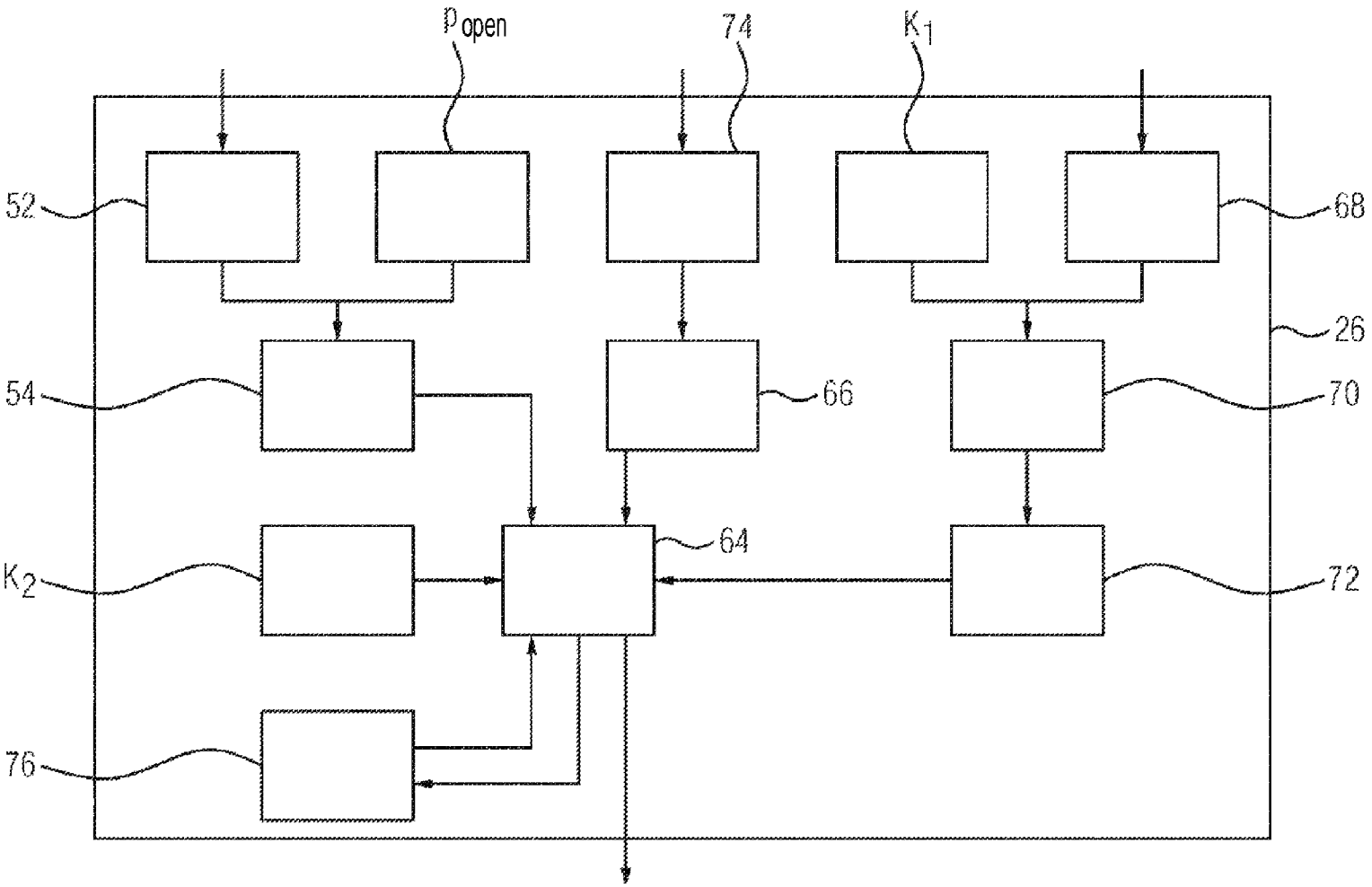
FIG. 6 is a schematic illustration of a control device which is designed for carrying out the actuation method as per FIG. 5.

For this purpose, as per the flow diagram in FIG. 5, it is firstly the case that a period duration $t_p$ of the pressure oscillation in the high-pressure region 16 is determined. Here, the period duration $t_p$ corresponds to a duration between the time at which the pump piston 32 reaches a first top dead center TDC and a time at which the pump piston 32 next reaches a top dead center. Owing to the mechanical connection of the high-pressure fuel pump 14 to the internal combustion engine, the position of the camshaft 34 and thus of the top dead center TDC of the pump piston 32 are known and are stored in a first characteristic map K1 in the control device 26, wherein the characteristic map K1 assigns every crankshaft angle a position of the pump piston 32. Also arranged in the control device 26 is a crank angle acquisition device 68 by means of which the control device 26 may acquire the present crankshaft angle. A TDC detection device 70 may therefore, from the data of the first characteristic map K1 and the data of the crankshaft acquisition device 68, detect when the pump piston 32 is situated at a top dead center TDC. This information is fed to an evaluation device 72 which is arranged in the control device 26 and which, from the information, determines the period duration $t_p$. Furthermore, the evaluation device 72 divides the period duration $T_p$ into four evenly distributed quadrants Q1, Q2, Q3 and Q4.

In the actuation method, it is subsequently, analogously to the overrun deactivation, identified whether a fault situation is present in the fuel injection system 10. If a fault situation is present, there is firstly a waiting period until a fuel demand detection device 74 detects whether a fuel demand from the internal combustion engine is present, that is to say whether an injection via the injector valves 42 is required. If this is the case, the injection time $t_I$ is firstly set to an arbitrary time. Then, by means of the camshaft adjuster 58, which is driven by the camshaft angle adjustment device 64, an angle of the camshaft 34 relative to the pump piston 32 is adjusted such that the previously set injection time $t_I$ falls into the pressure trough of the pressure oscillation from FIG. 2, that is to say into the duration of the second quadrant Q2 or of the third quadrant Q3.

However, if no fuel demand is present, no injection via the injector valves 42 is performed.

To be able to adjust the camshaft angle in targeted fashion, a second characteristic map K2 is stored in the control device 26, which second characteristic map assigns every camshaft angle of the camshaft 34 relative to the pump piston 32 a predetermined time at which the pump piston 32 is situated at the top dead center TDC. Also arranged in the control device 26 is a memory device 76 which stores the present camshaft angle. The data of the characteristic map K2 and of the memory device 76 are fed to the camshaft angle adjustment device 64, in order that the camshaft angle may be adjusted in targeted fashion. Furthermore, the camshaft angle adjustment device 64 outputs a signal to the camshaft adjuster 58 only if the information regarding when the injection through the injector valves 42 is supposed to start is present, that is to say when the injection time $t_I$ has been set. The camshaft adjuster 58 adjusts the angle of the camshaft 34 only when a fault situation is actually present, wherein the camshaft angle adjustment device 64 is additionally fed with the information from the evaluation device 72 as regards where the pressure trough 50 is presently situated.

If the fault detection device 54 identifies that no fault situation is present, and if the fuel demand detection device 74 detects that fuel is demanded by the internal combustion engine, fuel is injected entirely normally via the injector valves 42 into the respective combustion chambers. In the absence of a fuel demand, however, the injector valves 42 do not open.

The method in which the camshaft angle is adjusted in order to thereby shift the injection time $t_I$ into a pressure trough 50 is also carried out continuously in order to thereby detect whether the fuel injection system 10 has entered a normal mode and the pressure p in the high-pressure region 16 lies below the opening pressure $P_{open}$ again. In this case, the adjustment of the camshaft 34 is ended in a manner dependent on the set injection time $t_I$.

Therefore, if the high-pressure fuel pump 14 is mechanically driven by means of a camshaft 34 which exhibits a means for adjusting the angle, that is to say a so-called camshaft adjuster 58, which may be hydraulically or electrically operated, then in the event of a fault situation being detected, the camshaft 34 is adjusted by means of the camshaft adjuster 58 such that the start of injection, that is to say the injection time $t_I$, falls into the negative amplitude, that is to say into the pressure trough 50, of the rail pressure oscillation as per FIG. 2. Therefore, the injector valves 42 may still open even if the averaged pressure in the pressure accumulator 40 lies above the pressure $P_{max}$ critical for the injector opening. Therefore, a functionality is proposed by means of which an adjustment of the camshaft 34 by means of the camshaft adjuster 58 is possible, such that the start of injection of the injector valves 42 is relocated into regions expedient with regard to pressure, specifically the pressure troughs 50. This function is also stored in the control device 26, and the functionality may optionally be withdrawn again in a manner dependent on the pressure conditions in the fuel injection system 10.

Figure 7:
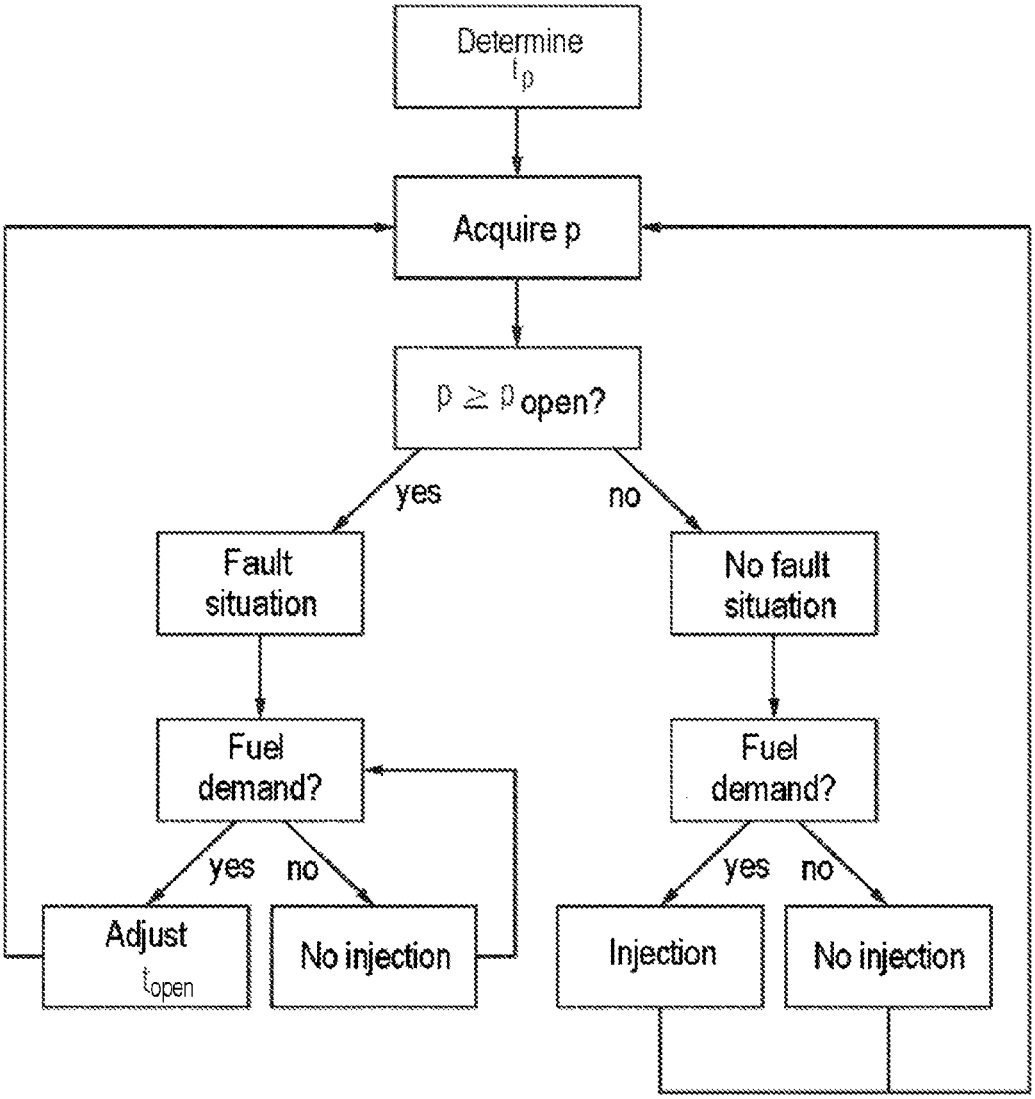
FIG. 7 shows a flow diagram which schematically illustrates an actuation method for the actuation of an injector valve of the fuel injection system from FIG. 1 in a fault situation of the fuel injection system.
Figure 8:
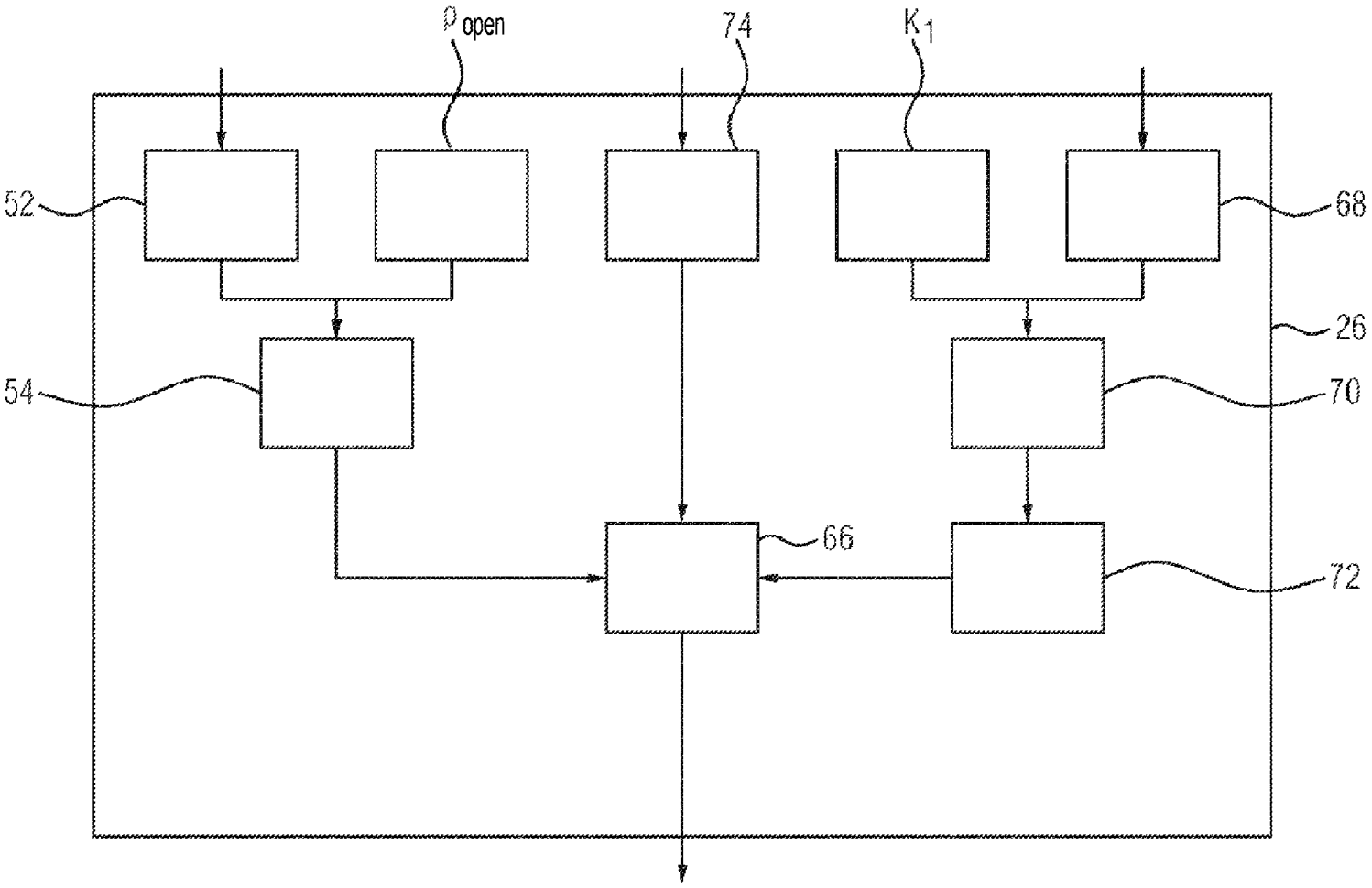
FIG. 8 shows a control device which is designed for carrying out the actuation method as per FIG. 7.

Below, with regard to FIG. 7 and FIG. 8, a third method will be described with which it is sought for an opening of the injector valves 42 to remain possible even in the fault situation of the fuel injection system 10. This method may be carried out in addition to the overrun deactivation and as an alternative to the adjustment of the camshaft 34. Here, too, the phenomenon is utilized whereby an injector valve 42 that seeks to open during a pressure peak 48 must open counter to a higher pressure than if it were to do so in a pressure trough 50. The difference between the pressure peak 48 and the pressure trough 50 is system-dependent, and may amount to for example 50 bar.

If the respective injector valve 42 opens in a pressure trough 50, the temperature and rotational speed range in which operation of the internal combustion engine is possible is expanded in relation to the injection during the pressure peak 48. Alternatively, a less expensive or more robust design of the pressure-limiting valve 46 may also be used, with the result of higher maximum pressures $P_{max}$, and under some circumstances exhibit comparable exhibited operation of the internal combustion engine.

As already described, the pressure peak 48 in the high-pressure region 16 correlates with the top dead center TDC of the high-pressure fuel pump 14, wherein the propagation time of the fuel through the fuel injection system 10 proceeding from the outlet valve 36 must additionally be observed. Owing to the mechanical connection of the high-pressure fuel pump 14 to the internal combustion engine, the position of the top dead center TDC is known. As is also the case in the other methods, the fault situation is detected by detection of an undesirably high pressure in the high-pressure region 16 by means of the high-pressure sensor 44.

The start of injection of the injector valves 42 is stored in the control device 26 as a characteristic map.

As in the case of the method for the adjustment of the camshaft angle, the period duration tp between two TDC points of the pump piston 32 is determined, and the period duration TP is divided into four equally sized quadrants Q1 to Q4. Here, the injector valves 42 are actuated such that the opening time $T_{open}$ of the injector valves 42 lies in an opening duration which extends into the second quadrant Q2 and into the third quadrant Q3. This means that the camshaft 34 is not adjusted, but rather the opening time $T_{open}$ of the injector valves 42 is actively shifted. By shifting the opening time $T_{open}$ into the pressure trough 50 specifically only after detection of the fault situation, the described advantages may be utilized. The shift of the opening time $T_{open}$ during operation of the internal combustion engine is not relevant to emissions, because it is a fault situation.

Therefore, in the method, as in the case of the adjustment of the camshaft 34, the period duration tp is firstly determined, and it is then detected whether or not a fault situation is present.

In this case, too, the injector valves 42 are actuated only when a fuel demand from the internal combustion engine is actually present. If this is the case, the opening time $T_{open}$, is shifted into the second quadrant Q2 or third quadrant Q3 of the period duration tp. However, if no fuel demand is present, no injection occurs.

After the shift of the opening time $T_{open}$, it is in turn checked whether the fuel injection system 10 remains in a fault situation, because it is optionally possible in this case too for the functionality to be withdrawn again if the fuel injection system 10 enters the normal mode again. In this case, the injection in the period duration tp occurs as desired in any of the four quadrants Q1 to Q4 directly in accordance with a fuel demand from the internal combustion engine.

Therefore, in the control device 26, a functionality is stored which, after the detection of a fault situation with an associated pressure increase in the high-pressure region 16, shifts the existing opening time $T_{open}$ of the injector valves 42 for normal operation into a range which is more optimum for emergency running of the internal combustion engine. For this purpose, in the control device 26, a corresponding characteristic map may be stored, for example in the form of the opening time setting device 66, which shifts the opening time $T_{open}$ of the injector valves 42 such that it lies in the pressure trough 50. The characteristic map may optionally be configured as a function of pressure and/or temperature and/or rotational speed of the internal combustion engine.

The shift of the opening time $T_{open}$ may optionally be withdrawn again in a manner dependent on the pressure conditions in the system.

The foregoing embodiments have been shown and described for the purposes of illustrating the structural and functional principles of the present invention, as well as illustrating the methods of employing the embodiments and are subject to change without departing from such principles. Therefore, this invention includes all modifications encompassed within the scope of the following claims.

The invention claimed is:

1. An operating method for operating a fuel injection system of an internal combustion engine, the method comprising:

providing a fuel injection system, having a high-pressure fuel pump with a pump piston which is movable in translational fashion in a pressure chamber during operation and which serves for highly pressurizing a fuel, having a high-pressure region for storing the highly pressurized fuel, and having at least one injector valve which is connected to the high-pressure region and which serves for injecting highly pressurized fuel into a combustion chamber of the internal combustion engine;

providing at least two operating states of the internal combustion engine, wherein, in an overrun mode, no injection of fuel through the at least one injector valve into the combustion chamber takes place, wherein, in an injection mode, at least one injection of fuel through the at least one injector valve into the combustion chamber takes place;

providing a pressure-limiting valve which, when a predefined opening pressure is reached in the high-pressure region, discharges fuel from the high-pressure region into the pressure chamber of the high-pressure fuel pump;

detecting a fault situation in the fuel injection system, wherein the predefined opening pressure is overshot in the high-pressure region;

deactivating the overrun mode of the internal combustion engine in the fault situation, such that the internal combustion engine is operated exclusively in the injection mode;

determining a period duration with four evenly distributed quadrants between a first top dead center time, at which the pump piston is at a top dead center, and a second top dead center time, at which the pump piston is at the top dead center; and actuating the at least one injector valve such that an opening time of the at least one injector valve lies in an opening duration which extends in at least one of a second quadrant of the four evenly distributed quadrants of the period duration and a third quadrant of the four evenly distributed quadrants of the period duration.

2. The operating method as claimed in claim 1, wherein the fuel injection system includes a high-pressure sensor and the fault situation is detected by the high-pressure sensor.

3. The operating method as claimed in claim 1, further comprising setting the predefined opening pressure of the pressure-limiting valve to be lower than a maximum admissible maximum pressure in the high-pressure region, wherein the maximum admissible pressure is defined in a range above 500 bar.

4. The operating method as claimed in claim 3, further comprising injecting a quantity of fuel through the at least one injector valve so that a pressure lower than the maximum pressure takes effect in the high-pressure region.

5. The operating method as claimed in claim 1, further comprising injecting a quantity of fuel through the at least one injector valve so that a pressure that corresponds to the opening pressure of the pressure-limiting valve is set in the high-pressure region.

6. The operating method as claimed in claim 1, further comprising, following deactivating the overrun mode, detecting re-entry in a normal mode of the fuel injection system in which the predefined opening pressure is undershot in the high-pressure region, and reactivating the overrun mode.

7. The operating method as claimed in claim 1, further comprising, detecting the first and second top dead center times at which the pump piston is situated at the top dead center, and performing at least one of storing a characteristic map which assigns a predetermined crank angle of the internal combustion engine to the top dead center, and acquiring a crank angle of the internal combustion engine.

8. The operating method as claimed in claim 1, wherein pressure in the high-pressure region has cyclic pressure peaks and pressure troughs, and the second and third quadrants correspond to at least one trough of the pressure troughs.

9. An operating method for operating a fuel injection system of an internal combustion engine, the method comprising:

providing a fuel injection system, having a high-pressure fuel pump with a pump piston which is movable in translational fashion in a pressure chamber during operation and which serves for highly pressurizing a fuel, having a high-pressure region for storing the highly pressurized fuel, and having at least one injector valve which is connected to the high-pressure region and which serves for injecting highly pressurized fuel into a combustion chamber of the internal combustion engine;

providing at least two operating states of the internal combustion engine, wherein, in an overrun mode, no injection of fuel through the at least one injector valve into the combustion chamber takes place, wherein, in an injection mode, at least one injection of fuel through the at least one injector valve into the combustion chamber takes place;

providing a pressure-limiting valve which, when a predefined opening pressure is reached in the high-pressure region, discharges fuel from the high-pressure region into the pressure chamber of the high-pressure fuel pump;

detecting a fault situation in the fuel injection system, wherein the predefined opening pressure is overshot in the high-pressure region;

deactivating the overrun mode of the internal combustion engine in the fault situation, such that the internal combustion engine is operated exclusively in the injection mode;

determining a period duration with four evenly distributed quadrants between a first top dead center time, at which the pump piston is at the top dead center, and a second top dead center time, at which the pump piston is at the top dead center, defining an injection time at which the at least one injector valve begins to inject fuel, and adjusting a camshaft angle of the camshaft relative to the pump piston such that the injection time lies in a duration which extends in at least one of a second quadrant of the period duration and a third quadrant of the period duration.

10. A fuel injection system for injecting fuel into combustion chambers of an internal combustion engine, the fuel injection system comprising:

a high-pressure fuel pump with a pump piston which moves in translational fashion in a pressure chamber during operation and which serves for highly pressurizing a fuel;

a high-pressure region for storing the highly pressurized fuel;

at least one injector valve which is connected to the high-pressure region and which serves for injecting highly pressurized fuel into a combustion chamber of the internal combustion engine;

a pressure-limiting valve which, when a predefined opening pressure is reached in the high-pressure region, discharges fuel from the high-pressure region into the pressure chamber of the high-pressure fuel pump; and a control device which is configured to provide at least two operating state of the internal combustion engine, wherein, in an overrun mode, no injection of fuel through the at least one injector valve into the combustion chamber takes place, wherein, in an injection mode, at least one injection of fuel through the at least one injector valve into the combustion chamber takes place;

detect a fault situation in the fuel injection system, wherein pressure in the high-pressure region exceeds the predefined opening pressure; and deactivate the overrun mode of the internal combustion engine in the fault situation, such that the internal combustion engine is operated exclusively in the injection mode, wherein pressure in the high-pressure region has cyclic pressure peaks and pressure troughs, wherein a period duration with four evenly distributed quadrants is determined between a first top dead center time at which the pump piston is at a top dead center, and a second top dead center time at which the pump piston is at the top dead center, and wherein the at least one injector valve is actuated such that an opening time of the at least one injector valve lies in an opening duration which extends in at least one of a second quadrant of the four evenly distributed quadrants of the period duration and a third quadrant of the four evenly distributed quadrants of the period duration, the second and third quadrants corresponding to a trough of the pressure troughs.

11. The fuel injection system of claim 10, wherein the predefined opening pressure of the pressure-limiting valve is set to be lower than a maximum admissible maximum pressure in the high-pressure region, and wherein a quantity of fuel is injected through the at least one injector valve so that a pressure lower than the maximum pressure takes effect in the high-pressure region.

12. The fuel injection system of claim 10, wherein a quantity of fuel is injected through the at least one injector valve so that a pressure that corresponds to the opening pressure of the pressure-limiting valve is set in the high-pressure region.

13. The fuel injection system of claim 10, wherein a quantity of fuel is injected through the at least one injector valve so that a pressure that corresponds to the opening pressure of the pressure-limiting valve is set in the high-pressure region.

14. The fuel injection system of claim 10, wherein, upon a detection of re-entry into a normal mode of the fuel injection system in which pressure in the high-pressure region is below the predefined opening pressure, the overrun mode is reactivated.

15. The fuel injection system of claim 10, wherein, for detection of the top dead center times at which the pump piston is situated at the top dead center, at least one of a characteristic map is stored which assigns a predetermined crank angle of the internal combustion engine to the top dead center, and a crank angle of the internal combustion engine is acquired.

16. A fuel injection system for injecting fuel into combustion chambers of an internal combustion engine, the fuel injection system comprising:

a high-pressure fuel pump with a pump piston which moves in translational fashion in a pressure chamber during operation and which serves for highly pressurizing a fuel;

a high-pressure region for storing the highly pressurized fuel;

at least one injector valve which is connected to the high-pressure region and which serves for injecting highly pressurized fuel into a combustion chamber of the internal combustion engine;

a pressure-limiting valve which, when a predefined opening pressure is reached in the high-pressure region, discharges fuel from the high-pressure region into the pressure chamber of the high-pressure fuel pump; and a control device which is configured to provide at least two operating state of the internal combustion engine, wherein, in an overrun mode, no injection of fuel through the at least one injector valve into the combustion chamber takes place, wherein, in an injection mode, at least one injection of fuel through the at least one injector valve into the combustion chamber takes place;

detect a fault situation in the fuel injection system, wherein pressure in the high-pressure region exceeds the predefined opening pressure; and deactivate the overrun mode of the internal combustion engine in the fault situation, such that the internal combustion engine is operated exclusively in the injection mode, wherein pressure in the high-pressure region has cyclic pressure peaks and pressure troughs, and wherein the control device is further configured to determine a period duration with four evenly distributed quadrants between a first top dead center time, at which the pump piston is at the top dead center, a second top dead center time, at which the pump piston is at the top dead center, define an injection time at which the at least one injector valve begins to inject fuel, and adjust at least one of the injection time and a camshaft angle of the camshaft relative to the pump piston such that the injection time lies in a duration which extends in at least one of a second quadrant of the period duration and a third quadrant of the period duration, the second and third quadrants corresponding to at least one of the pressure troughs.

17. The fuel injection system of claim 16, wherein the at least one of the injection time and the camshaft angle comprises the camshaft angle.

18. The fuel injection system of claim 16, wherein the at least one of the injection time and the camshaft angle includes the injection time.

* * * * *